US009974383B2

(12) United States Patent
Hughes, Jr.

(10) Patent No.: US 9,974,383 B2
(45) Date of Patent: May 22, 2018

(54) COSMETIC BRUSH CLEANING SYSTEM AND METHOD FOR CLEANING A COSMETIC BRUSH USING THE SAME

(71) Applicant: Robert K. Hughes, Jr., Fort Myers, FL (US)

(72) Inventor: Robert K. Hughes, Jr., Fort Myers, FL (US)

( * ) Notice: Subject to any disclaimer, the term of this patent is extended or adjusted under 35 U.S.C. 154(b) by 0 days. days.

(21) Appl. No.: 15/496,832

(22) Filed: Apr. 25, 2017

(65) Prior Publication Data

US 2017/0332776 A1 Nov. 23, 2017

Related U.S. Application Data

(60) Provisional application No. 62/327,171, filed on Apr. 25, 2016.

(51) Int. Cl.
*A46B 17/06* (2006.01)
*A46B 17/08* (2006.01)

(52) U.S. Cl.
CPC ..... *A46B 17/06* (2013.01); *A46B 17/08* (2013.01)

(58) Field of Classification Search
CPC ..... A46B 17/06; A46B 17/08; F26B 17/28; F26B 5/14; B44D 3/00
USPC ..... 34/312, 58; 134/900, 140; 15/38
See application file for complete search history.

(56) References Cited

U.S. PATENT DOCUMENTS 1,537,625 A * 5/1925 Skinner ..... F26B 5/14 34/58
2,794,264 A * 6/1957 Scholtka ..... B44D 3/006 15/38
2,794,265 A * 6/1957 Kruger ..... B44D 3/006 134/900
3,837,091 A * 9/1974 Meyer ..... B44D 3/006 134/149
5,588,221 A * 12/1996 Hoeltke ..... A46B 17/06 34/58
6,088,933 A * 7/2000 Mallalieu ..... F26B 5/08 148/529
6,972,129 B1 * 12/2005 Ogawa ..... A61K 8/06 106/412

(Continued)

FOREIGN PATENT DOCUMENTS

CA 1218253 A * 2/1987 ..... A46B 17/02
FR 2763826 A1 * 12/1998 ..... A46B 13/06

(Continued)

*Primary Examiner* — Stephen M Gravini
(74) *Attorney, Agent, or Firm* — Bracewell LLP; Brad Y. Chin

(57) ABSTRACT

Embodiments provide a cosmetic brush cleaning system and method which spins a brush and provides centrifugal force at varying speeds to clean the brush head. The brush can be used for the application of makeup and the brush can either slide into an attachment which is then connected via a magnetic coupling mechanism to secure the brush before it is spun and cleaned, or the brush itself can be provided with the magnetic coupling component inherently in the brush. The operator of the device determines the speed that is necessary based upon the type of liquid the brush has been in contact with and the operator uses a controller to speed up or slow down the rotational mechanism. The centrifugal force removes the material sticking to the brush while it is cleaned.

13 Claims, 2 Drawing Sheets

(56) References Cited

U.S. PATENT DOCUMENTS

| | | | | |
|---|---|---|---|---|
| 9,062,597 | B2 * | 6/2015 | Schlote | F02B 45/00 |
| 2011/0005018 | A1 * | 1/2011 | Zheng | A47L 13/14 15/228 |
| 2017/0332776 | A1 * | 11/2017 | Hughes, Jr. | A46B 17/08 |

FOREIGN PATENT DOCUMENTS

| | | | | | |
|---|---|---|---|---|---|
| GB | 190924968 | A | * | 9/1910 | D01G 19/22 |
| GB | 191018979 | A | * | 2/1911 | A46B 13/04 |

* cited by examiner

COSMETIC BRUSH CLEANING SYSTEM AND METHOD FOR CLEANING A COSMETIC BRUSH USING THE SAME

BACKGROUND

Field

Embodiments of the invention generally relate to a cosmetic brush cleaning system and a method for cleaning a cosmetic brush using the same. More specifically, embodiments relate to a cosmetic brush attached to a rotation mechanism, such that the cosmetic brush can be cleaned using centrifugal force exerted through spinning the cosmetic brush, using the rotation mechanism, at various speeds, depending on the type of brush and the preference of the operator. Cleaning of a cosmetic brush, using the cosmetic cleaning brush system and the cosmetic brush cleaning method according to various embodiments, is quicker and more efficient than using a conventional cosmetic brush cleaning system and method.

Description of the Related Art

There is a long standing problem in cosmetics for brushes to be easily and efficiently cleaned. Cosmetic brushes are commonly used to apply makeup, and after repeated use, they can become caked with makeup material. The bristles of cosmetic brushes are delicate and require extra care, so that the bristles are not damaged during cleaning. It is important to effectively clean these brushes in order to ensure their longevity and so that they effectively apply makeup. Normally, cosmetic brushes are cleaned by placing them in a tank or container that applies a cleaning agent to the bristles of the cosmetic brushes, while a set of rotational cleaning brushes contained in the tank or container removes any makeup material remaining on the cosmetic brushes after the application of makeup This setup effectively removes the excess makeup material still remaining on the cosmetic brush, but does not provide for the ease and quickness of use that is desirable for those who constantly need to quickly apply makeup and other substances using the cosmetic brushes.

A number of conventional cosmetic brush cleaning systems include a container having a bottom portion with a plurality of projections for spreading the cosmetic brush bristles. Further, a liquid solution is added to the container to clean the brushes (i.e., to react with the makeup material on the cosmetic brushes). Subsequently, the cosmetic brushes must be removed from the container to dry. Multiple brushes can be cleaned in the container.

Some cosmetic brush cleaning systems provide a holder with aligned V-shaped recesses for receiving the handle of a cosmetic brush. The holder contains a long rod for reception within the chuck of a power driven drive member, such as a drill. Some conventional brush cleaning systems hold multiple cosmetic brushes or other types of brushes in a retention area, and use a cleaning solution, water, an ultraviolet cleaning source, an ultrasonic cleaning source, gentle agitation, or a combination thereof to clean the cosmetic brushes contained therein. Paint brush cleaners known in the art also can take a paint brush or roller and insert it into a drill that spins the brush inside a tubular container.

However, these conventional brush cleaners require more time and effort for cleaning brushes than one who routinely needs to clean and reuse brushes effectively in a makeup application setting. It is thus desirable to have a cosmetic makeup brush be cleaned in an efficient and quick manner so that the brush can be quickly reused.

SUMMARY

According to at least one embodiment, a cosmetic brush of any size or shape is slid into an attachment piece so that it is secure and stable. The attachment piece contains an attachment unit such as a magnetic peg, screw, metal piece or snap of any size or shape, which is counter sunk into the attachment piece. The attachment piece is then fitted into a rotational mechanism, where the attachment unit is secured into a rotational mechanism, which rotates at a speed preset by the user based on the material that is on the brush head. The end of the tool will have a magnet, snap-in, clamp, or another suitable means for receiving the brush. There can be an on/off switch provided towards the top or bottom of the tool, and the switch may provide various speeds to spin the brush. The tool will spin at speeds above 1,000 rotations per minute (RPM), and can reach speeds of up to 28,0000 RPM. The Dremel Model 8050 can potentially be used to spin the brush depending on the setup.

According to at least one embodiment, the magnetic peg, screw, or snap of any size or shape for connecting to a rotational mechanism is counter-sunk into the handle of the cosmetic brush.

According to at least one embodiment, the magnetic peg, screw, or snap is sunk into the actual handle on the brush. The peg is then connected to the drill or rotation mechanism directly without the need for an attachment piece, and the brush is rotated at a speed chosen by the user based on the material that is on the brush head.

Various objects, advantages and features of the invention will become apparent from the following description of embodiments with reference to the accompanying drawings.

Embodiments provide a cosmetic brush cleaning system, including an attachment piece configured to accept a handle of a cosmetic brush head, and an attachment unit on the attachment piece configured to couple the attachment piece and the cosmetic brush head to a rotation mechanism. According to at least one embodiment, the attachment piece and cosmetic brush head interlock with the rotation mechanism through the attachment unit, so that a user can program a rotational speed of the rotation mechanism to control a rotational frequency of the cosmetic brush head, based upon a type of the cosmetic brush head and a type of makeup material on the cosmetic brush head, so that residual makeup material remaining on the cosmetic brush head is removed through a centrifugal force.

According to at least one embodiment, the attachment unit is embedded into the attachment piece.

According to at least one embodiment, the attachment unit includes one of a peg, a screw, and a snap.

According to another embodiment, there is provided a cosmetic brush cleaning system, including a rotation mechanism, an attachment piece configured to accept a handle of a cosmetic brush head, and an attachment unit on the attachment piece configured to couple the attachment piece and the cosmetic brush head to the rotation mechanism. According to at least one embodiment, the attachment piece and cosmetic brush head interlock with the rotation mechanism through the attachment unit, so that a user can program a rotational speed of the rotation mechanism to control a rotational frequency of the cosmetic brush head, based upon a type of the cosmetic brush head and a type of makeup material on the cosmetic brush head, so that residual makeup material remaining on the cosmetic brush head is removed through a centrifugal force.

According to at least one embodiment, the rotation mechanism is configured to rotate at a speed such that the rotations per minute of the rotation mechanism is greater for the residual makeup material which does not require a liquid to dilute the residual makeup material.

According to at least one embodiment, a liquid on the cosmetic brush head is diluted for thicker material such that a slower rotational speed of the rotation mechanism allows the dilution liquid to break down the residual makeup material on the cosmetic brush head.

According to at least one embodiment, a speed of the rotation mechanism greater than 1,000 RPM is used to remove the residual makeup material from the cosmetic brush head.

According to another embodiment, there is provided a method for cleaning a cosmetic brush head of a cosmetic brush, including the steps of sliding a handle of the cosmetic brush into an attachment piece so that the handle fits into the attachment piece, coupling the attachment piece to a rotation mechanism through the use of an attachment unit which is shaped to be accepted by the rotation mechanism, and spinning the attachment piece and cosmetic brush after interlocking with the rotation mechanism through the attachment unit, so that a user can program a rotational speed of the rotation mechanism to control a rotational frequency of the cosmetic brush head, based upon a type of the cosmetic brush head and a type of makeup material on the cosmetic brush head, so that residual makeup material remaining on the cosmetic brush head is removed through a centrifugal force.

According to at least one embodiment, the method further includes increasing a rotational speed of the rotation mechanism for the residual makeup material which does not require a liquid to dilute the residual makeup material.

According to at least one embodiment, the method further includes applying a liquid on the cosmetic brush head to dilute a thicker residual makeup material such that a slower rotational speed of the rotation mechanism allows the dilution liquid to break down the residual makeup material on the cosmetic brush head.

According to at least one embodiment, the method further setting a speed of the rotation mechanism greater than 1,000 RPM to remove the residual makeup material from the cosmetic brush head.

According to at least one embodiment, the attachment unit is embedded into the attachment piece.

According to at least one embodiment, the attachment unit includes one of a peg, a screw, and a snap.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

DETAILED DESCRIPTION

Figure 1:
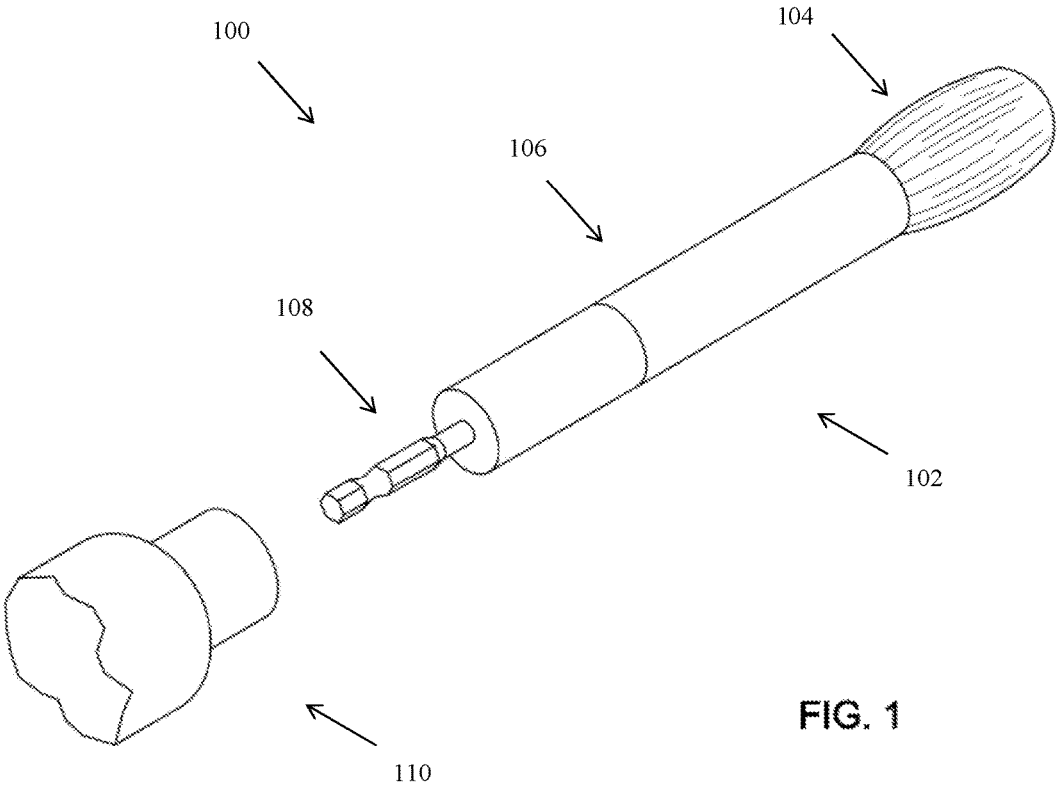
FIG. 1 is a side view of a cosmetic brush cleaning system having an attachment unit sunk in a handle of the cosmetic brush, in accordance with an embodiment.

Advantages and features of the present invention and methods of accomplishing the same will be apparent by referring to embodiments described below in detail in connection with the accompanying drawings. However, the present invention is not limited to the embodiments disclosed below and may be implemented in various different forms. The embodiments are provided only for completing the disclosure of the present invention and for fully representing the scope of the present invention to those skilled in the art.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention. Like reference numerals refer to like elements throughout the specification.

Hereinafter, various embodiments of the present invention will be described in detail with reference to the accompanying drawings.

Embodiments relate to a cosmetic brush cleaning system and a method for cleaning a cosmetic brush using the same. In particular, a cosmetic brush of various shapes and sizes can be cleaned using the cosmetic brush cleaning system and method, according to various embodiments, quicker than a cosmetic brush using a conventional washing method. In one embodiment, the cosmetic brush includes a coupler, including, for example, a peg, a screw, a drill bit attachment, a metal piece, or a snap, that can be magnetized and can be of any shape or size, and which can be inserted into a rotational mechanism, for example, a drill, as a non-limiting example. According to another embodiment, the cosmetic brush cleaning system includes an attachment piece having a cavity on a first end and an attachment unit on a second end. The cosmetic brush, according to at least one embodiment, slides into the cavity of the attachment piece. The attachment unit includes, for example, a peg, a screw, or a snap, as non-limiting examples, so that it can be coupled with the rotational mechanism.

In accordance with at least one embodiment, as shown in FIG. 1, a brush cleaning system 100 includes a brush port 102 and a rotational motion mechanism 110. The brush port 102 includes, for example, a plurality of bristles 104, an outer sheath 106, and an attachment unit 108. According to at least one embodiment, the attachment unit 108 is sunk or counter-sunk in a handle of the brush port 102. The attachment unit 108 inserts into the rotational mechanism 110 to couple the brush port 102 with the rotational motion mechanism 110. The rotational motion mechanism 110 is then rotated based on input from a user who controls the rotation of the cosmetic brush in terms of a length of time and a speed of the rotation. The speed of rotation (i.e., rotations per minute (RPM)) of the cosmetic brush can be varied, for instance, so that if a cosmetic brush has a thicker material thereon it can be spun at lower speeds. The RPMs in this instance would be lower for a material that is thicker and requires a dilution by water or another generic cleaning substance to remove the excess makeup material on the cosmetic brush. The RPMs would be higher for a substance that does not require a pre-treatment process. For example, a cosmetic brush having a makeup material would be spun at a rate higher than 1,000 RPMs, because it does not require a pre-treatment. Further, if the cosmetic brush does not require a cleaning solution to dilute the makeup material on the bristles, the cosmetic brush head can be spun at a greater rate than if it does require the cleaning solution to dilute the makeup material. The RPM speed can vary between In accordance with at least one embodiment, the bristles 104 are attached to the outer sheath 106 via a metal partition member (not shown in FIG. 1). However, it would have been within the common knowledge of one of ordinary skill in the relevant art to have implemented other attachment means to ensure that the bristles 104 are not removed when the brush port 102 is being cleaned. The bristles 104 can also be of any material that is common to those who apply makeup, including all types of synthetic and natural material.

In accordance with at least one embodiment, the outer sheath 106 is made of a plastic material, although other hard surfaces are also contemplated according to other embodiments of the invention. The shape of the brush port 102 can be a cylinder with various concave and convex portions, and also other shapes, such as a rectangular structure are also contemplated according to other embodiments of the invention.

In accordance with at least one embodiment, as further shown in FIG. 1, the attachment unit 108 is made of any magnetized material and can also be made of plastic. One of ordinary skill in the relevant would have understood, however, that the attachment unit 108 can have various shapes, such as a peg, a snap, or a screw, as non-limiting examples, that fit into the rotational motion mechanism 110, and various sizes depending upon the interface of the rotational motion mechanism 110.

In accordance with at least one embodiment, the rotational motion mechanism 110 is part of a drill, as a non-limiting example, and generates speeds for rotational the brush port 102 based on the user input. The rotational motion mechanism provides for various interfaces for the attachment unit 108, and also consists of one or more rotational motors mounted on a board, so that multiple cosmetic brush heads can be spun at once.

In accordance with at least one embodiment, as further shown in FIG. 1, the brush port 102 is first used to apply makeup with any standard product that is commercially available, such as a blush product, a non-limiting example. Once the makeup has been applied either once or a few times, the user places the brush port 102 via the attachment unit 108 in the rotational motion mechanism 110, which has a holder (not shown). The shape of the attachment unit 108 permits it to fit into a normal drill chuck, or the attachment unit 108 can be any shape desired depending on the rotational motion mechanism 110. The rotational motion mechanism 110 includes, for example, a drill, but is not limited to that particular application. For example, there could be a stationary rotational motion mechanism 110 behind the makeup counter that can be used to spin multiple brushes. The rotational motion mechanism 110 interlocks with the attachment unit 108 to provide a point of rotation, whereby the centrifugal forces expel the makeup material from the cosmetic brush, thus cleaning the cosmetic brush.

Figure 3:
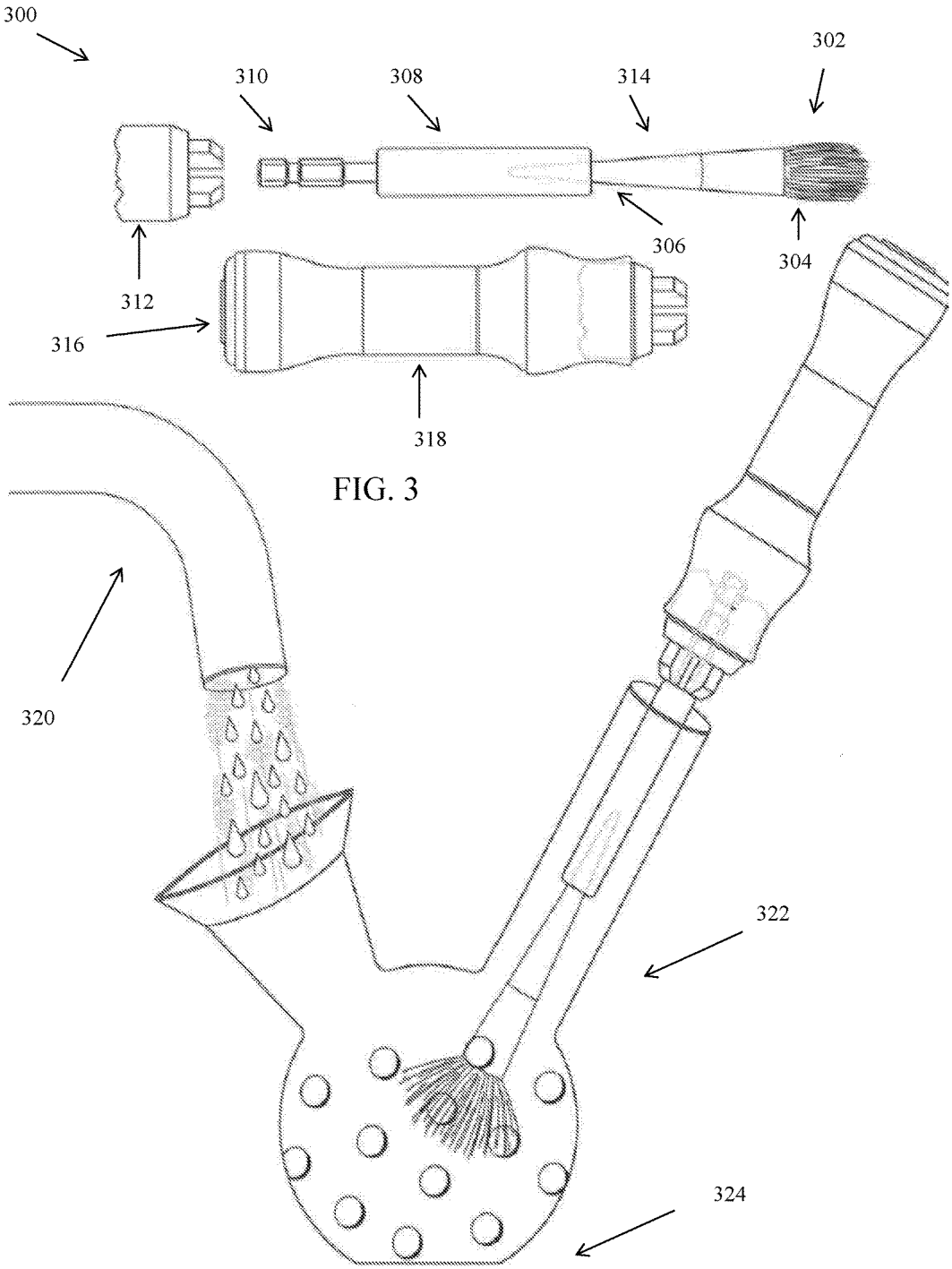
FIG. 3 is a schematic diagram showing a cosmetic brush cleaning system, in accordance with another embodiment.

After the brush port 102 is attached to the rotational motion mechanism 110, the user can program in a speed and length of time to the rotational motion mechanism 110, so that the cosmetic brush is adequately cleaned. The cosmetic brush can be rotated at a speed of up to 1,000 RPM for a cosmetic brush, which has been treated with a dilution material and over 1,000 RPM for one that has not been treated, for example. Depending on the makeup material, the cosmetic brush can be rotated faster or slower. A makeup material with a higher level of thickness is rotated at a higher speed to remove all of the makeup material from the cosmetic brush head. After the brush is adequately cleaned, the user removes the brush port 102 from the rotational motion mechanism 110, and applies makeup as needed. The makeup could be spun into a sink, or the brush could be stuck into the end of a vacuum cleaner as shown in FIG. 3. Also another embodiment includes that the brush could be spun as water flows through a flask with a faucet attached and out the holes, and when the fluid is clear, then the brush is clean.

Figure 2:
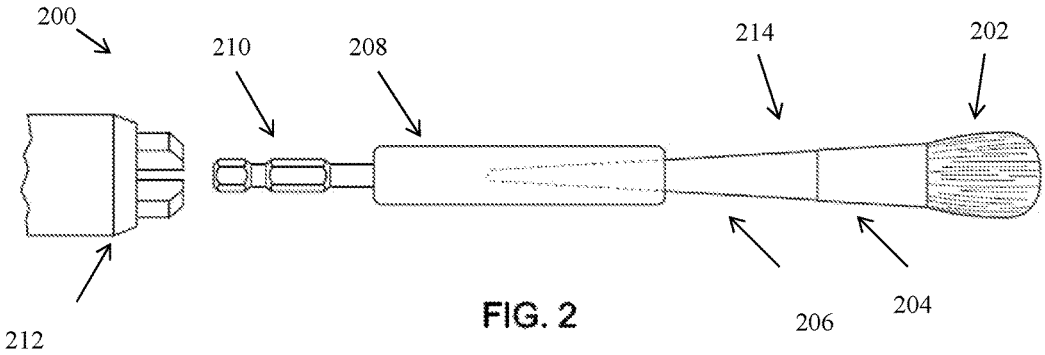
FIG. 2 is a schematic diagram showing a cosmetic brush cleaning system, which is slid into an attachment piece having an attachment unit for coupling the attachment piece with the rotational mechanism for cleaning the brush, in accordance with an embodiment.

FIG. 2 shows a second embodiment of the cosmetic brush cleaning system 200 and method. The cosmetic brush 214 contains bristles 202, a metal piece 204 that connects the bristles with the brush body 206. The brush 214 slides snugly into the attachment piece 208, which can vary in size, through the attachment opening. Further, the attachment piece 208 contains an attachment unit 210 for securing the attachment member in the rotational mechanism 212. The dotted lines show where the cosmetic brush 214 would fit into the attachment piece 208, and this opening can be of any shape or size. Other lengths of attachments and shapes can also be used depending on the shape of the cosmetic brush.

The bristles 202 can be of any material that is common to brushes, including but not limited to horse hair, metal filament, synthetic materials, etc. The shape of the brush head is not limited to the figure shown, but can include more traditional make-up brush head configurations.

The metal piece 204 connecting the bristles 202 to the brush body 206 can be of any metal that is easily bendable and can secure the bristles to the body. The shape of the metal piece will be determined based upon the brush body 206 and the bristle head 202.

The brush body 206 is attached to the brush bristles by the metal piece 204. This body can be of any material including plastic and metal and varies depending upon the application of makeup. Its shape will vary based upon the type of makeup application it is used for and can be longer or shorter and wider or thinner depending upon the application.

The brush body 206 slides snugly into the attachment piece 208. Attachment piece 208 can have many configurations to ensure that the brush is securely in place in order to clean the material and so that it won't fall out when rotated at high speeds. Most common is a triangular shape that gets skinnier as the distance proceeds from the opening, but other opening sizes and shapes are known based on the brush being used.

The attachment piece 208 has an attachment unit 210 that connects the brush body 206 to the rotational mechanism 212. The attachment unit 210 can fit into a normal drill bit chuck, or it can be designed to fit into a number of different rotational mechanisms in order to clean the brush. The attachment unit can be a peg, snap or screw.

The rotational mechanism 212 can be a common drill or can be a generic programmable rotational device so that the user can program it to speed up and slow down at a predetermine interval.

After the brush body 206 is securely into the attachment piece 208, the attachment piece is secured into the rotational mechanism 212 through the attachment unit 210, which is sunk or counter sunk into the attachment piece 208. Again, the rotational mechanism 212 can be a drill or other device which can be programmed by a user to rotate at a specific speed depending on the material in the brush head. After spinning the brush head 202 at a predetermined speed for a predetermined time, the user can remove the attachment piece 208 from the rotational mechanism and then remove the cosmetic brush 214 from the attachment piece 208.

Various sizes and shapes can be used for the attachment piece 208 to hold cosmetic brushes of various makes and models. After the user is done cleaning the cosmetic brush it is removed from the attachment piece 208 and the user can reuse the cleaned brush to apply makeup. Instead of being forced to clean up the makeup brushes by rolling them in the hand or other more complicated methods and systems, this embodiment makes it easier to more quickly clean the makeup brush. Various speeds and lengths can be set by the user either through a computer touch screen or a touch pad that is provided with the rotation apparatus.

The material of the attachment piece 208 is a plastic or any other suitable and flexible material that is sturdy enough to spin and hold securely the brush. The attachment unit 210 on the bottom of the attachment piece can be made of any type of magnetize metal, or plastic. The attachment piece 208 is preferably plastic with a portion on one end open so that the brush can slide into the attachment. The other end contains the attachment unit which can be sunk or counter sunk into the attachment piece.

The rotational device 212 interlocks with the attachment piece 208 through the attachment unit 210 in order to provide a point of rotation whereby the centrifugal forces can expel the material from the brush, thus cleaning the brush. The drill can also be programmable to spin at different speeds depending on the brush being used. Some brushes may require a more gentle spin rate.

FIG. 3 shows another embodiment of the system 300. The drill head of the rotational device 312 interlocks with the attachment piece 308 through the attachment unit 310. The body 318 of the rotational device 312 has a button 116 on the bottom of the body 318 for turning the rotational device 312 on and off in this embodiment, but it can be programmed to allow for differing speeds depending on the brush type. In the embodiment in FIG. 3, a brush 314 with bristles 304 is slid snugly into the attachment piece 308. This is then secured using the attachment unit 310 into the rotational device 312. The whole combination can be lowered into a container 322 which has a vacuum applied to it 324, and where the brush 314 is spun, while water or another liquid is added via a pipe 320. The container 322 can have holes as shown to remove the excess dirty liquid and other containers of different shapes and sizes can also be used depending on the shape of the brush. The pipe 320 can be a faucet or other mechanism to provide water to the container 322, which can be a flask of various shapes and sizes. The fluid flows out the holes and when the fluid is all clear, the brush would be clean.

What is claimed is:

1. A cosmetic brush cleaning system, comprising:

an attachment piece configured to accept a handle of a cosmetic brush head; and an attachment unit on the attachment piece configured to couple the attachment piece and the cosmetic brush head to a rotation mechanism, wherein the attachment piece and cosmetic brush head interlock with the rotation mechanism through the attachment unit, so that a user can program a rotational speed of the rotation mechanism to control a rotational frequency of the cosmetic brush head, based upon a type of the cosmetic brush head and a type of makeup material on the cosmetic brush head, so that residual makeup material remaining on the cosmetic brush head is removed through a centrifugal force.

2. The cosmetic brush cleaning system of claim 1, wherein the attachment unit is embedded into the attachment piece.

3. The cosmetic brush cleaning system of claim 1, wherein the attachment unit comprises one of a peg, a screw, and a snap.

4. A cosmetic brush cleaning system, comprising:

a rotation mechanism;

an attachment piece configured to accept a handle of a cosmetic brush head; and an attachment unit on the attachment piece configured to couple the attachment piece and the cosmetic brush head to the rotation mechanism, wherein the attachment piece and cosmetic brush head interlock with the rotation mechanism through the attachment unit, so that a user can program a rotational speed of the rotation mechanism to control a rotational frequency of the cosmetic brush head, based upon a type of the cosmetic brush head and a type of makeup material on the cosmetic brush head, so that residual makeup material remaining on the cosmetic brush head is removed through a centrifugal force.

5. The cosmetic brush cleaning system of claim 4, wherein the rotation mechanism is configured to rotate at a speed such that the rotations per minute of the rotation mechanism is greater for the residual makeup material which does not require a liquid to dilute the residual makeup material.

6. The cosmetic brush cleaning system of claim 4, wherein a liquid on the cosmetic brush head is diluted for thicker material such that a slower rotational speed of the rotation mechanism allows the dilution liquid to break down the residual makeup material on the cosmetic brush head.

7. The cosmetic brush cleaning system of claim 4, wherein a speed of the rotation mechanism greater than 1,000 RPM is used to remove the residual makeup material from the cosmetic brush head.

8. A method for cleaning a cosmetic brush head of a cosmetic brush, comprising:

sliding a handle of the cosmetic brush into an attachment piece so that the handle fits into the attachment piece;

coupling the attachment piece to a rotation mechanism through the use of an attachment unit which is shaped to be accepted by the rotation mechanism; and spinning the attachment piece and cosmetic brush after interlocking with the rotation mechanism through the attachment unit, so that a user can program a rotational speed of the rotation mechanism to control a rotational frequency of the cosmetic brush head, based upon a type of the cosmetic brush head and a type of makeup material on the cosmetic brush head, so that residual makeup material remaining on the cosmetic brush head is removed through a centrifugal force.

9. The cosmetic brush cleaning method of claim 8, further comprising:

increasing a rotational speed of the rotation mechanism for the residual makeup material which does not require a liquid to dilute the residual makeup material.

10. The cosmetic brush cleaning method of claim 8, further comprising:

applying a liquid on the cosmetic brush head to dilute a thicker residual makeup material such that a slower rotational speed of the rotation mechanism allows the dilution liquid to break down the residual makeup material on the cosmetic brush head.

11. The cosmetic brush cleaning method of claim 8, further comprising:

setting a speed of the rotation mechanism greater than 1,000 RPM to remove the residual makeup material from the cosmetic brush head.

12. The cosmetic brush cleaning method of claim 8, wherein the attachment unit is embedded into the attachment piece.

13. The cosmetic brush cleaning method of claim 8, wherein the attachment unit comprises one of a peg, a screw, and a snap.

* * * * *